United States Patent [19]

Svec

[11] 4,128,431

[45] Dec. 5, 1978

[54] COMPOSITION FOR MAKING AN INVESTMENT MOLD FOR CASTING AND SOLIDIFICATION OF SUPERALLOYS THEREIN

[75] Inventor: Paul S. Svec, Scotia, N.Y.

[73] Assignee: General Electric Company, Schenectady, N.Y.

[21] Appl. No.: 721,536

[22] Filed: Sep. 8, 1976

Related U.S. Application Data

[62] Division of Ser. No. 590,970, Jun. 27, 1975, Pat. No. 4,024,300.

[51] Int. Cl.[2] ..... B28B 7/34

[52] U.S. Cl. ..... 106/38.35; 106/38.3; 106/38.9; 106/65; 106/69; 164/26

[58] Field of Search ..... 106/38.2, 38.22, 38.35, 106/69, 287 S, 38.3, 38.9, 65; 164/26

[56] References Cited

U.S. PATENT DOCUMENTS

| | | | |
|---|---|---|---|
| 3,436,235 | 4/1969 | Baer et al. | 106/38.35 |
| 3,445,250 | 5/1969 | Preece | 106/38.3 |
| 3,754,945 | 8/1973 | Moore | 106/38.35 |

*Primary Examiner*—Lorenzo B. Hayes

*Attorney, Agent, or Firm*—Donald M. Winegar; Joseph T. Cohen; Charles T. Watts

[57] ABSTRACT

A composition for making shell investment molds for the casting and solidification of superalloys therein embodies preparing a primary slurry composition of a mixture of three different flour grain sizes of fused alumina and a silica binder. The flour grain sizes range from approximately 240 mesh to approximately 400 mesh, U.S. Standard or Tyler screen series.

4 Claims, No Drawings

COMPOSITION FOR MAKING AN INVESTMENT MOLD FOR CASTING AND SOLIDIFICATION OF SUPERALLOYS THEREIN

This is a division, of application Ser. No. 590,970, filed June 27, 1975, now U.S. Pat. No. 4,024,300.

BACKGROUND OF THE INVENTION

1. Field of the Invention

This invention relates to the process for making shell investment molds for the casing and solidification of superalloys therein.

2. Description of the Prior Art

Shell investment molds are employed to produce castings of a wide variety of alloys with a refractory material, compatible with the alloying being cast forming the inner mold wall. The secondary or back-up coats usually are composed of a high alumina-silicate refractory of an appropriate grain size to insure production of a useable mold. Long periods of time, up to 10 hours, coupled with high temperatures (1500°-1600° C.) caused undesirable mold defects, such as total collapse after casting the alloys, premature cracking and mold warpage. All of these, of course, produce undesirable and unacceptable castings. Mold-metal reactions, such as "pock marks," were also noted, suggesting that the inner or primary coats became contaminated with excessive amounts of $SiO_2$, $Na_2O$, and other fluxing agents which were not compatible with the alloy being cast.

An object of this invention is to provide a new and improved process for making shell investment molds for the casting and solidification of superalloys which overcome the deficiencies of the prior art.

An object of this invention is to provide a new and improved process for making a slurry suitable for making shell investment molds suitable for use for extended periods of time at high temperatures.

Another object of this invention is to provide a new and improved primary slurry composition for an investment mold, the material of which at the mold-metal interface is non-reactive to the metal in contact therewith.

Another object of this invention is to provide a new and improved alumina slurry to withstand the effects of mold-metal reactions at the mold-metal interface, such as required for the directional solidification of nickel-base superalloys and high-temperature nickel-base eutectic alloys requiring long solidification periods to obtain the desired cast structure.

Other objects of this invention will, in part, be obvious and will, in part, appear hereinafter.

BRIEF DESCRIPTION OF THE INVENTION

In accordance with the teachings of this invention, there is provided a material composition suitable for use in making shell investment molds. The material composition comprises a pre-selected weight of a flour mixture consisting of at least two different flour grain sizes of fused alumina. The grain sizes range from approximately 240 mesh to approximately 400 mesh, U.S. Standard or Tyler screen series.

A pre-selected weight of a colloidal silica is employed as a binder. In addition, a pre-selected volume of a wetting agent ranging from 8 to 12cc per 100 lbs of slurry mixture may be added to the mixture. The ratio of weight percent of the flour to the binder is 73:27 to 65:35. Preferably, the fused alumina flour employed is acid-washed to remove free iron contamination resulting from its manufacture and has an $Al_2O_3$ purity of greater than 98%. The weight percent of silica in the colloidal silica binder is from 15 to 36 percent.

When a flour mixture consists of two different flours, the ratio of the larger grain to the smaller grain flour may vary from between 10:90 and 90:10. When the mixture consists of three different flour sizes, the first or coarse flour comprises from 70 to 75% weight percent of the mixture, the second flour comprises from 10 to 20%, and the third or smallest grain size flour comprises the remainder.

DESCRIPTION OF THE PREFERRED EMBODIMENT

Unexpectedly, I have found that a mixture of two or more flour sizes of fused alumina provide an excellent material composite for the one or more primary coats required to form a suitable inner mold wall for the casting of metal therein and the directional solidification thereof. Fused alumina flour sizes are closely controlled by the manufacturer, since they are basically produced for other uses. Therefore, a mixture of two or more fused alumina flours is preferred to acquire a grain size distribution to decrease voids at the metal-mold interface and to produce a slurry in which settling of the refractory flour is nil. Fused alumina is chosen because of its inherent low expansion and contraction properties, high temperature capability, and resistance to attack by the materials being cast.

Preferably, the flour is a high-purity alumina greater than 98% by weight $Al_2O_3$. The flour is acid-washed to remove impurities, such as iron, which is detrimental to the formulation of a suitable primary slurry.

Grain sizes must be considered since surface finish of molds and mold permeability is important when an acceptable casting is desired. A flour mixture containing a high percentage of large grains will produce a rough inner mold wall. This roughness is reproduced on the casting surface. A flour containing a large percentage of "fines" requires an excessive amount of binder and usually causes mold wall "buckling".

The colloidal silica binder is available as a commercial product and contains 36% silica by weight. This colloidal solution is diluted with de-ionized water to vary the silica content from 36% by weight to 15% by weight. I prefer to dilute the binder to 18% by weight and employ this diluted binder in the primary slurry. Total percentage of diluted binder may vary from 27% by weight to 35% by weight of the total slurry, depending on the flour mixture employed.

Other slurry additions are required. A wetting agent to ensure proper wetting of the wax pattern by the slurry. I prefer a non-ionic wetting agent since these are compatible with the binder (colloidal silica) employed. These agents are readily available commercially. Also, a defoaming agent may be required if excessive foam is noted on the slurry during the mixing operation. If good slurry mixing practices are followed, foaming will not be a serious problem. I have employed Antifoam 60, manufactured by the General Electric Company, in the amounts of 0.005% by weight to 0.008% by weight of the slurry, directly to the slurry. I have found 8cc to 12cc of wetting agent per 100 lbs. total weight of the slurry will induce good wetting properties to the slurry.

The following flour mixtures have been employed and yield satisfactory primary slurries. All percentages are by weight percent and all flours are fused alumina, U.S. Standard sieve size, acid washed.

| | |
|---|---|
| Mix #1: | Mix #6 |
| 240 mesh 50% | 240 mesh 65% |
| 400 mesh 50% | 320 mesh 35% |
| Mix #2: | Mix #7: |
| 240 mesh 66% | 240 mesh 85% |
| 320 mesh 34% | 400 mesh 15% |
| Mix #3: | Mix #8: |
| 240 mesh 50% | 240 mesh 70% |
| 320 mesh 50% | 320 mesh 25% |
| Mix #4: | 400 mesh 5% |
| 240 mesh 90% | Mix #9: |
| 320 mesh 10% | 240 mesh 85% |
| Mix #5: | 320 mesh 15% |
| 320 mesh 90% | Mix #10: |
| 400 mesh 10% | 240 mesh 10% |
| | 320 mesh 90% |

An unsatisfactory primary slurry resulted when the following mixtures were employed:

Mix #11: 240 mesh 100% Mix #12: 320 mesh 100%

Primary slurries containing 100% 240 mesh $Al_2O_3$ flour produced fragile shells which cracked on dewaxing. Penetration of molten metal and casting roughness, which was unacceptable, resulted when the molds which did not crack on dewaxing were employed. Primary slurries containing 100%, 320 grain size flour, were difficult to keep in suspension without excessive stirring and produced mold defects such as mold wall "buckling".

The following is illustrative of the preparation of primary slurry compositions of this invention wherein I have selected Mix #4 containing 240 mesh fused alumina at 90% and 320 mesh fused alumina at 10% by weight of the flour mixture as a particular illustration. Total weight of the slurry (flour and binder) is 100 lbs. The dry flours are blended together for approximately ½ hour. Total weight of the binder is 27% by weight. The binder is colloidal silica diluted with de-ionized water to 18% silicon content. Therefore, 27 lbs. of this mixture is diluted binder and 73 lbs. is flour mixture #4.

Approximately 90% of the total weight of the flour mixture was added to all of the binder which is contained in a suitable mixer. The constituents were mixed together until the viscosity of the slurry became stabilized. The remainder of the flour mixture was then added to the slurry. The slurry of flour and binder were allowed to mix slowly overnight.

After mixing overnight, the specific gravity and viscosity of the slurry was checked. I prefer a specific gravity of from about 2.36 to about 2.42 and a viscosity of from 7 to 10 seconds with a #5 Zahn cup. An adjustment may be made at this time if specific gravity land viscosity are not at desired levels. Additionally, a nonionic defoamer may be added, in amounts previously stated, if foaming is a problem at this time.

A wetting agent is added only after the specific gravity and viscosity are at the desired levels for the slurry. Amounts of from about 8cc to about 12cc per 100 lbs. appear to be sufficient to induce good wetting properties. I allow from about 10 to 15 minutes for the wetting agent to be properly mixed throughout the slurry.

Several wax patterns were fabricated, cleaned and dried by standard established procedures well known to those skilled in the art. The wax patterns were then dipped into the primary slurry and the excess slurry was allowed to drain. When draining was completed, the bubble-free slurry coat was ready for graining. Graining was accomplished by means of fluid bed equipment. I prefer 70 grain fused alumina, acid washed, of 98% or greater purity as the grain employed for the graining or sand coat. This size grain forms an excellent grain coat to receive the next slurry dip coat. The wax pattern or cluster was allowed to air dry at room temperature for at least two hours.

When properly dried, the wax patterns or cluster was then dipped in the primary slurry and again coated with the 70 grain $Al_2O_3$. Again, the cluster was allowed to dry in air at room temperature for at least two hours. This procedure completed the application of the two primary coats which I prefer in making an investment mold. It is to be noted that when desired, more than two primary coats may be applied.

Secondary coats are then applied after the primary coats are dry enough to accept them. This is usually in about two hours after the last primary coat is applied. Secondary grain coats and slurry coats are applied in the same manner as the primary grain and slurry coats. However, the composition differs. For this shell mold composite the secondary slurry consists of 240 mesh fused alumina flour, acid washed, and 36 grit size fused alumina as the grain coat. I prefer to add four secondary coats each of which consists of one slurry dip and one 36 grain application. Drying time between each coat is at least thirty minutes. The binder is colloidal silica, of which 36 percent by weight is silica. The binder is not diluted. The ratio of undiluted binder to flour is 30:70. A slurry with a specific gravity of from about 1.9 to about 2.1 and a viscosity of approximately 6–7 seconds #5 Zahn cup is desired. A binder comprising about 30 percent by weight silica was also found to be suitable for making the secondary coating.

A "seal" coat consisting of the secondary slurry mixture is applied as the final coat. The purpose of the seal coat is to keep the last grain coat in place.

Preferably, I desire the shell investment mold for the aformentioned high temperature applications to be composed of two primary slurry coats each grained with 70 mesh fused alumina, four secondary slurry coats each grained with 36 mesh fused alumina, and one seal coat of secondary slurry. The complete shell is dried at room temperature, preferably overnight or for at least 12 hours. The shells are now ready for dewaxing.

Any standard technique well known to those skilled in the art may be employed for dewaxing. I prefer to employ the "flash dewax" technique. After dewaxing, the shells are fired in air at 1000° C. for 1.5 hours and allowed to furnace-cool. The composition of the material of shell mold of the completed shells may then be stored for future use or employed immediately in the casting and solidification of super alloys.

Shell investment molds fabricated in the manner described heretofore are pre-heated to 1680°–1700° C. and the superalloy materials previously described are cast therein and directionally solidified. The resulting castings are superior in quality of surface finish and composition of matter than those obtained by use of prior art molds.

Particularly, it has been discovered that the novel mold compositions, particularly the compositions of the primary slurry coatings, enable the formation of a metal-mold barrier layer to be formed. It is this novel barrier, which is formed in a controlled prevailing furnace atmosphere, that is reducing for silica, which enables excellent surface finishes to be obtained for the castings. The reducing atmosphere enables alumina to dissolve into the silica and remove the silica from the mold-metal interface.

Upon drying the material the primary and secondary coatings have approximately the following composition:

(1) Primary coating the alumina to silica ratio by weight percent is from about 89:11 to approximately 95:5

(2) Secondary coating the alumina to silica ratio by weight percent is from about 84:16 to approximately 93:7. Overall, alumina comprises from 80 to 99.9 percent by weight of the total mold material after drying.

I claim as my invention:

1. In a primary slurry mixture having a specific gravity of from about 2.36 to about 2.42 and a viscosity of from about 7 to about 10 as measured with a No. 5 Zahn cup for making an investment mold comprising water, a wetting agent, a refractory material in amounts of from about 65% to about 73% and;

a binder material comprising an aqueous based colloidal silica solution having a silica content of from 15 percent to 36 percent;

the improvement comprising, as said refractory material, a mixture of three different grain sizes of fused alumina having grain sizes within the range of about 240 to about 400 mesh, U.S. Sieve Series; said mixture comprising 70 to 75% by weight of largest grain size, 10 to 20% by weight of medium grain size and the balance of smallest grain size.

2. The mixture of claim 1 wherein the purity of the alumina is greater than 98 percent.

3. The mixture of claim 2 wherein the alumina is substantially free of iron contamination.

4. The mixture of claim 1 including from about 8cc to 12cc per 100 pounds of slurry mixture of a non-ionic wetting agent.

* * * * *